US008318646B2

(12) United States Patent
Andrews et al.

(10) Patent No.: US 8,318,646 B2
(45) Date of Patent: Nov. 27, 2012

(54) LUBRICATING OIL COMPOSITION

(75) Inventors: Mark D. Andrews, Oxford (GB); Benjamin R. Elvidge, Oxford (GB)

(73) Assignee: Infineum International Limited (GB)

( * ) Notice: Subject to any disclaimer, the term of this patent is extended or adjusted under 35 U.S.C. 154(b) by 51 days.

(21) Appl. No.: 12/553,123

(22) Filed: Sep. 3, 2009

(65) Prior Publication Data

US 2010/0062956 A1 Mar. 11, 2010

(30) Foreign Application Priority Data

Sep. 5, 2008 (EP) ..... 08105244

(51) Int. Cl.
*C10M 137/10* (2006.01)
*C10M 167/00* (2006.01)

(52) U.S. Cl. ..... 508/371; 508/374

(58) Field of Classification Search ..... 508/371, 508/374

See application file for complete search history.

(56) References Cited

U.S. PATENT DOCUMENTS 5,013,465 A * 5/1991 Colclough ..... 508/370
2004/0235688 A1* 11/2004 Locke et al. ..... 508/586

* cited by examiner

*Primary Examiner* — Walter D Griffin
*Assistant Examiner* — Francis C Campanell

(57) ABSTRACT

A lubricating oil composition comprising (A) an oil of lubricating viscosity in a major amount; and, (B) as an additive component in a minor amount, an oil-soluble zinc salt of a dithiophosphoric acid, the dithiophosphoric acid being the reaction product of phosphorus pentasulphide with a mixture of at least one first alcohol of the formula ROH where R is an aliphatic hydrocarbyl group having at least four carbon atoms or is an alkaryl group, and at least one second alcohol which is an ester of a polyhydric alcohol.

22 Claims, No Drawings

LUBRICATING OIL COMPOSITION

FIELD OF THE INVENTION

The present invention relates to automotive lubricating oil compositions, more especially to automotive lubricating oil compositions for use in piston engines, especially gasoline (spark-ignited) and diesel (compression-ignited), crankcase lubrication, such compositions being referred to as crankcase lubricants. In particular, although not exclusively, the present invention relates to automotive lubricating oil compositions, having low levels of phosphorus, and preferably also low levels of sulfur and/or sulfated ash, which exhibit enhanced phosphorus retention; and to the use of additives in such compositions for improving phosphorus retention.

BACKGROUND OF THE INVENTION

A crankcase lubricant is an oil used for general lubrication in an internal combustion engine where an oil sump is situated generally below the crankshaft of the engine and to which circulated oil returns. It is well known to include additives in crankcase lubricants for several purposes.

Phosphorus in the form of dihydrocarbyl dithiophosphate metal salts have been used as extreme pressure, antiwear and antioxidant additives in lubricating oil compositions for internal combustion engines. The metal may be an alkali or alkaline earth metal, or aluminum, lead, tin, molybdenum, manganese, nickel or copper. Of these, zinc salts of dihydrocarbyl dithiophosphate (ZDDPs) are most commonly used. While such compounds are particularly effective antioxidants and antiwear agents such compounds introduce phosphorus, sulfur and sulfated ash into the engine which not only contaminates and shortens the service life of exhaust gas after-treatment devices but also creates environmental concerns. Such exhaust gas after-treatment devices may include catalytic converters, which can contain one or more oxidation catalysts, $NO_X$ storage catalysts, and/or $NH_3$ reduction catalysts; and or a particulate trap.

Oxidation catalysts can become poisoned and rendered less effective by exposure to certain elements present in engine exhaust gases, particularly by exposure to phosphorus and phosphorus containing compounds introduced into the exhaust gas by the degradation of phosphorus containing lubricant additives. Reduction catalysts are sensitive to sulfur and sulfur containing compounds in the engine exhaust gas introduced by the degradation of both the base oil used to blend the lubricant, and sulfur containing lubricating additives. Particulate traps can become blocked by metallic ash, which is a product of degraded metal-containing lubricating oil additives.

In response to these problems, OEM specifications for "new service fill" and "first fill" lubricants have continually sought to reduce the maximum allowable limits of phosphorus, sulfur and sulfated ash (SAPS) contents of lubricating oil compositions. At the same time, such OEM specifications also stipulate that the lubricating oil composition must provide adequate lubricating performance. With the first licensed use of ILSAC (International Lubricant Standardization Approval Committee) GF-1 in October 1992, phosphorus levels were limited to no more than 1200 parts per million (ppm), with GF-3 in July 2001 to 1000 ppm and with GF-4 in January 2004 to 800 ppm. However, even at these reduced levels of phosphorus, contamination of exhaust gas after-treatment devices, especially oxidation catalysts, is still an issue.

Suitably, lubricating oil compositions that exert a minimum negative impact on exhaust gas after-treatment devices must be identified.

SUMMARY OF THE INVENTION

The present invention is based on the discovery that a lubricating oil can be formulated which complies with the lower maximum allowable limits of phosphorus, and preferably the lower limits of sulfur and/or sulfated ash, as stipulated in OEM specifications, and the lubricating oil exhibits enhanced phosphorus retention, thereby reducing the exposure of exhaust gas after-treatment devices to phosphorus and phosphorus containing compounds introduced into the exhaust gas and prolonging the service life of such devices.

In accordance with a first aspect, the present invention provides a lubricating oil composition having a phosphorus concentration, expressed as atoms of phosphorus, of not greater than 0.09 mass %, based on the total mass of the composition, the lubricating oil composition comprising:

(A) an oil of lubricating viscosity present in a major amount; and, (B) as an additive component present in a minor amount, an oil-soluble zinc salt of a dithiophosphoric acid, the dithiophosphoric acid being the reaction product of phosphorus pentasulphide with a mixture of at least one first alcohol of the formula ROH where R is an aliphatic hydrocarbyl group having at least four carbon atoms or is in an alkaryl group, and at least one second alcohol which is an ester of a polyhydric alcohol.

According to a second aspect, the present invention provides a method of lubricating a compression-ignited or spark-ignited internal combustion engine, comprising operating the engine with a lubricating oil composition according to the first aspect of the invention.

Preferably, the method according to the second aspect of the present invention comprises lubricating the crankcase of a compression-ignited or spark-ignited internal combustion engine.

According to a third aspect, the present invention provides a method of improving the efficiency and/or reducing the contamination of an exhaust gas after treatment device of an internal combustion engine, the exhaust gas after treatment device including a catalyst, the method comprising operating the engine with a lubricating oil composition according to the first aspect of the invention.

According to a fourth aspect, the present invention provides the use of a lubricating oil composition according to the first aspect of the invention in an internal combustion engine to improve the efficiency and/or reduce the contamination of an exhaust gas after treatment device of the internal combustion engine, wherein the exhaust gas after treatment device includes a catalyst.

According to a fifth aspect, the present invention provides a method of reducing the concentration of phosphorus and/or phosphorus containing compounds introduced into the exhaust gas of an internal combustion engine, the method comprising operating the engine with a lubricating oil composition according to the first aspect of the invention.

According to a sixth aspect, the present invention provides the use of a lubricating oil composition according to the first aspect of the invention in an internal combustion engine to reduce the concentration of phosphorus and/or phosphorus containing compounds introduced into the exhaust gas during operation of the engine.

According to a seventh aspect, the present invention provides the use, in the lubrication of the crankcase of an internal combustion engine, of an oil-soluble zinc salt of a dithiophosphoric acid, the dithiophosphoric acid being the reaction product of phosphorus pentasulphide with a mixture of at least one first alcohol of the formula ROH where R is an aliphatic hydrocarbyl group having at least four carbon atoms or is in an alkaryl group, and at least one second alcohol which is an ester of a polyhydric alcohol, to reduce the concentration of phosphorus and/or phosphorus containing compounds introduced into the exhaust gas during operation of the internal combustion engine.

In this specification, the following words and expressions, if and when used, have the meanings ascribed below:

- "active ingredients" or "(a.i.)" refers to additive material that is not diluent or solvent;
- "comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies;
- "hydrocarbyl" means a chemical group of a compound that contains hydrogen and carbon atoms and that is bonded to the remainder of the compound directly via a carbon atom. The group may contain one or more atoms other than carbon and hydrogen ("hetero atoms") provided they do not affect the essentially hydrocarbyl nature of the group;
- "oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;
- "reducing the concentration of phosphorus and/or phosphorus containing compounds introduced into the exhaust gas of an internal combustion engine" means an enhanced retention of phosphorus by the lubricating oil of the present invention as measured in accordance with the Sequence III G Test Procedure as described herein compared with an analogous lubricating oil composition where the additive component (B) has been replaced in its entirety with an oil soluble zinc salt of a dithiophosphoric acid, the dithiophosphoric acid being the reaction product of phosphorus pentasulfide with an alcohol of the formula ROH where ROH is the same as that used to make component (B) in the comparative lubricating oil of the present invention;
- "major amount" means in excess of 50 mass % of a composition;
- "minor amount" means less than 50 mass % of a composition;
- "TBN" means total base number as measured by ASTM D2896;
- "phosphorus content" is measured by ASTM D5185;
- "sulfur content" is measured by ASTM D2622;
- "sulfated ash content" is measured by ASTM D874; and,
- "phosphorus retention" is measured by the Sequence III G Test Procedure.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to each and all aspects of the invention, will now be described in more detail as follows:

Oil of Lubricating Viscosity (A)

The oil of lubricating viscosity (sometimes referred to as "base stock" or "base oil") is the primary liquid constituent of a lubricant, into which additives and possibly other oils are blended, for example to produce a final lubricant (or lubricant composition).

A base oil is useful for making concentrates as well as for making lubricating oil compositions therefrom, and may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil and heavy duty diesel oil. Generally the viscosity of the oil ranges from 2 to 30, especially 5 to 20, $mm^2s^{-1}$ at 100° C.

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Base oil may be categorised in Groups I to V according to the API EOLCS 1509 definition.

The oil of lubricating viscosity is provided in a major amount, in combination with a minor amount of additive component (B) as defined herein and, if necessary, one or more co-additives, such as described hereinafter, constituting a lubricating oil composition. This preparation may be accomplished by adding the additive directly to the oil or by adding it in the form of a concentrate thereof to disperse or dissolve the additive. Additives may be added to the oil by any method known to those skilled in the art, either before, at the same time as, or after addition of other additives.

Preferably, the oil of lubricating viscosity is present in an amount of greater than 55 mass %, more preferably greater than 60 mass %, even more preferably greater than 65 mass %, based on the total mass of the lubricating oil composition. Preferably, the oil of lubricating viscosity is present in an amount of less than 98 mass %, more preferably less than 95 mass %, even more preferably less than 90 mass %, based on the total mass of the lubricating oil composition.

The lubricating oil compositions of the invention may be used to lubricate mechanical engine components, particularly in internal combustion engines, e.g. spark-ignited or compression-ignited two- or four-stroke reciprocating engines, by adding the composition thereto. Preferably, they are crankcase lubricants.

The lubricating oil compositions of the invention comprise defined components that may or may not remain the same chemically before and after mixing with an oleaginous carrier. This invention encompasses compositions which comprise the defined components before mixing, or after mixing, or both before and after mixing.

When concentrates are used to make the lubricating oil compositions, they may for example be diluted with 3 to 100, e.g. 5 to 40, parts by mass of oil of lubricating viscosity per part by mass of the concentrate.

The lubricating oil composition of the present invention contains low levels of phosphorus, namely not greater than 0.09 mass %, preferably up to 0.08 mass %, more preferably up to 0.06 mass % of phosphorus, expressed as atoms of phosphorus, based on the total mass of the composition.

Typically, the lubricating oil composition may contain low levels of sulfur. Preferably, the lubricating oil composition contains up to 0.4, more preferably up to 0.3, most preferably up to 0.2, mass % sulfur, expressed as atoms of sulfur, based on the total mass of the composition.

Typically, the lubricating oil composition may contain low levels of sulfated ash. Preferably, the lubricating oil composition contains up to 1.0, preferably up to 0.8, mass % sulfated ash, based on the total mass of the composition.

Suitably, the lubricating oil composition may have a total base number (TBN) of between 4 to 15, preferably 5 to 11.

Additive Component (B)

This is obtainable by reacting a basic zinc compound with a dithiophosphoric acid obtainable by reacting phosphorus pentasulfide with a mixture of at least one first alcohol of the formula ROH, where R is an aliphatic hydrocarbyl group having at least four carbon atoms, and at least one second alcohol which is an ester of a polyhydric alcohol.

The group R of the at least one first alcohol of the formula ROH has, for example, 4 to 12 carbon atoms, preferably 4 to 8 carbon atoms, more preferably 4 to 6 carbon atoms. The group R may be an alkyl or alkaryl group but it is preferably an alkyl group.

Suitable alkyl groups which R may represent include n-butyl, iso-butyl, sec-butyl, amyl, sec-hexyl, n-heptyl, n-octyl, iso-octyl or n-decyl, such as, n-butyl, iso-butyl, sec-butyl, amy/or sec-hexyl, preferably sec-butyl, or 4-methyl-2-pentyl, more preferably 4-methyl-2-pentyl.

Preferably, when R represents an alkyl group, greater than 60 mole %, more preferably greater than 70 mole %, even more preferably greater than 80 mole %, even more preferably greater than 90 mole %, most preferably essentially all of the alkyl groups which R represents are secondary alkyl groups, especially 4-methyl-2-pentyl groups.

Suitable alkaryl groups which R may represent include an alkyl phenyl group, especially a $C_7$ to $C_{12}$ alkyl phenyl group, e.g. branched nonyl phenyl or branched dodecyl phenyl.

R may be a mixture, i.e. derived from a mixture of alcohols ROH as defined herein. In accordance with a preferred embodiment, R comprises a single aliphatic hydrocarbyl group, especially a single alkyl group as defined herein.

The second alcohol may have the formula $R^1(OH)_n$ where $R^1$ represents one or more ester containing moieties, preferably mono-ester containing moieties, containing hydrogen and carbon atoms and having at least 12 carbon atoms and n is 1 or 2. Preferably, the second alcohol is a glyceryl derivative having the formula

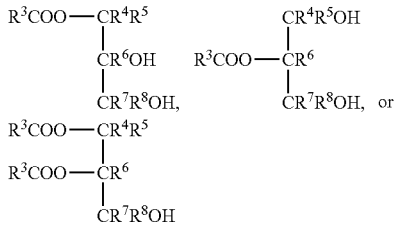

where $R^3$ is an aliphatic hydrogen- and carbon-containing group containing at least 9 carbon atoms and $R^4$, $R^5$, $R^6$, $R^7$ and $R^8$ are each independently hydrogen or alkyl groups. $R^3$ is preferably alkyl or alkenyl, usually with 9 to 30, preferably 12 to 26, more preferably 12 to 22, even more preferably 16 to 18, especially 18, carbon atoms. $R^3$ may for example be lauryl, myristyl, palmityl, stearyl, behenyl, oleyl, linoleyl or linolenyl, especially oleyl. $R^4$, $R^5$, $R^6$, $R^7$ and $R^8$ may be alkyl groups though they are all preferably hydrogen atoms.

Most preferably, the second alcohol comprises glycerol monooleate, glycerol dioleate or a mixture thereof, especially predominantly glycerol monooleate.

Suitably, the additive component (B) is formed by reacting a basic zinc compound with a dithiophosphoric acid obtainable by reacting phosphorus pentasulfide with a mixture comprising 75 to 95, preferably 75 to 90, mass % of the at least one first alcohol of the formula ROH and 5 to 25, preferably 10 to 25, mass % of the at least one second alcohol which is an ester of a polyhydric alcohol.

Suitably, the lubricating oil composition contains an amount of additive component (B) that introduces 0.02 to 0.09 wt. %, preferably 0.02 to 0.08 wt. %, more preferably 0.02 to 0.06 wt. % of phosphorus into the composition.

Suitably, the additive component (B) is present in an amount of 0.1 to 10 mass %, preferably 0.1 to 5 mass %, more preferably 0.1 to 2 mass %, of the lubricating oil composition, based on the total mass of the lubricating oil composition.

In accordance with a preferred embodiment of the present invention, the additive component (B) represents the sole phosphorus containing additive component in the lubricating oil composition.

Phosphorus Retention

The amount of phosphorus retained in a lubricating oil composition, particularly a crankcase lubricant, following operation of the engine for a specified period of time (t) may be calculated from the following formula:

$$\%\ P_{retention} = \left[\frac{(\%\ \text{wt}\ P_t)(\%\ \text{wt}\ M_0)}{(\%\ \text{wt}\ P_0)(\%\ \text{wt}\ M_t)}\right] \times 100$$

wherein: % wt $P_t$ is the percent by weight of phosphorus in the lubricating oil composition after operation of the engine for a period of time t; % wt $M_0$ is the percent by weight of detergent metal in the lubricating oil composition at the beginning of testing; % wt $P_0$ is the percent by weight of phosphorus in the lubricating oil composition at the beginning of testing; and, % wt $M_t$ is the percent by weight of detergent metal in the lubricating oil composition after operation of the engine for a period of time t. The weight percent of phosphorus and detergent metal in the lubricating oil composition may be determined by well known techniques, such as Inductively Coupled Plasma Atomic Emission Spectrometry.

Suitably, the percent phosphorus retention (% P retention) of the lubricating oil composition of the present invention is greater than 86%, preferably greater than 87%, even more preferably greater than 88%, even more preferably greater than 89%, most preferably at least 90%, when calculated in accordance with the above formula and measured in accordance with the Sequence III G Test Procedure which involves operating the Sequence III G test engine at 125 bhp, 3600 rpm and 150° C. oil temperature for 100 hours, interrupted at 20-hour intervals for oil checks, as described hereinafter.

The amount of phosphorus retained in the crankcase lubricant oil is indirectly proportional to the amount of phosphorus and phosphorus containing compounds introduced into the exhaust gas during operation of the engine. Suitably, the lubricating oil composition of the present invention introduces significantly low levels of phosphorus and phosphorus containing compounds into the exhaust gas. Consequently, the concentration of phosphorus and phosphorus containing compounds in the exhaust gas which contact the catalyst in the exhaust gas after-treatment device is at a significantly low level; contamination of the catalyst is reduced which provides an improvement in the efficiency and enhances the service life of the exhaust gas after-treatment device.

The catalyst in the exhaust gas after-treatment device may be an oxidation, reduction or $NO_x$ storage catalyst. Preferably, the catalyst comprises an oxidation catalyst. The catalyst may be of any conventional design. For example, the exhaust gas after-treatment device may comprise of flow through passages of ceramic or metallic material coated with a wash coat comprised of, for example, zeolite, aluminum oxide, silicon dioxide, titanium dioxide; the wash coat supporting a catalyst such as, platinum, palladium, rhodium, or iron.

Co-Additives

Co-additives, with representative effective amounts, that may also be present, different from additive component (B), are listed below. All the values listed are stated as mass percent active ingredient.

| Additive | Mass % (Broad) | Mass % (Preferred) |
|---|---|---|
| Ashless Dispersant | 0.1-20 | 1-8 |
| Metal Detergents | 0.1-15 | 0.2-9 |
| Friction modifier | 0-5 | 0-1.5 |
| Corrosion Inhibitor | 0-5 | 0-1.5 |
| Metal Dihydrocarbyl Dithiophosphate | 0-10 | 0-4 |
| Anti-Oxidants | 0-5 | 0.01-3 |
| Pour Point Depressant | 0.01-5 | 0.01-1.5 |
| Anti-Foaming Agent | 0-5 | 0.001-0.15 |
| Supplement Anti-Wear Agents | 0-5 | 0-2 |
| Viscosity Modifier (1) | 0-6 | 0.01-4 |
| Mineral or Synthetic Base Oil | Balance | Balance |

(1) Viscosity modifiers are used only in multi-graded oils.

The final lubricating oil composition, typically made by blending the or each additive into the base oil, may contain from 5 to 25, preferably 5 to 18, typically 7 to 15, mass % of the co-additives, the remainder being oil of lubricating viscosity.

The above mentioned co-additives are discussed in further detail as follows; as is known in the art, some additives can provide a multiplicity of effects, for example, a single additive may act as a dispersant and as an oxidation inhibitor.

A dispersant is an additive whose primary function is to hold solid and liquid contaminations in suspension, thereby passivating them and reducing engine deposits at the same time as reducing sludge depositions. For example, a dispersant maintains in suspension oil-insoluble substances that result from oxidation during use of the lubricant, thus preventing sludge flocculation and precipitation or deposition on metal parts of the engine.

Dispersants are usually "ashless", as mentioned above, being non-metallic organic materials that form substantially no ash on combustion, in contrast to metal-containing, and hence ash-forming materials. They comprise a long hydrocarbon chain with a polar head, the polarity being derived from inclusion of e.g. an O, P, or N atom. The hydrocarbon is an oleophilic group that confers oil-solubility, having, for example 40 to 500 carbon atoms. Thus, ashless dispersants may comprise an oil-soluble polymeric backbone.

A preferred class of olefin polymers is constituted by polybutenes, specifically polyisobutenes (PIB) or poly-n-butenes, such as may be prepared by polymerization of a $C_4$ refinery stream.

Dispersants include, for example, derivatives of long chain hydrocarbon-substituted carboxylic acids, examples being derivatives of high molecular weight hydrocarbyl-substituted succinic acid. A noteworthy group of dispersants is constituted by hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkylene polyamines with alkenyl succinic anhydrides, such as described in U.S. Pat. Nos. A-3,202,678; -3,154,560; -3,172,892; -3,024,195; -3,024,237, -3,219,666; and -3,216,936, that may be post-treated to improve their properties, such as borated (as described in U.S. Pat. Nos. A-3,087,936 and -3,254,025) fluorinated and oxylated.

For example, boration may be accomplished by treating an acyl nitrogen-containing dispersant with a boron compound selected from boron oxide, boron halides, boron acids and esters of boron acids.

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps", that is metal salts of acidic organic compounds.

Detergents generally comprise a polar head with a long hydrophobic tail, the polar head comprising a metal salt of an acidic organic compound. The salts may contain a substantially stoichiometric amount of the metal when they are usually described as normal or neutral salts and would typically have a total base number or TBN (as may be measured by ASTM D2896) of from 0 to 80. Large amounts of a metal base can be included by reaction of an excess of a metal compound, such as an oxide or hydroxide, with an acidic gas such as carbon dioxide. The resulting overbased detergent comprises neutralised detergent as an outer layer of a metal base (e.g. carbonate) micelle. Such overbased detergents may have a TBN of 150 or greater, and typically of from 250 to 500 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g. sodium, potassium, lithium, calcium and magnesium. The most commonly-used metals are calcium and magnesium, which may both be present in detergents used in a lubricant, and mixtures of calcium and/or magnesium with sodium.

Particularly preferred metal detergents are neutral and overbased alkali or alkaline earth metal salicylates having a TBN of from 50 to 450, preferably a TBN of 50 to 250. Highly preferred salicylate detergents include alkaline earth metal salicylates, particularly magnesium and calcium, especially, calcium salicylates. Preferably, the alkali or alkaline earth metal salicylate detergent is the sole detergent in the lubricating oil composition. Unexpectedly, it has been found that the use of a salicylate detergent improves the phosphorus retention of a lubricating oil composition containing a ZDDP additive, particularly additive component (B) in the lubricating oil composition of the present invention.

Friction modifiers include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted monoamines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Suitable oil-soluble organo-molybdenum compounds have a molybdenum-sulfur core. As examples there may be mentioned dithiocarbamates, dithiophosphates, dithiophosphinates, xanthates, thioxanthates, sulfides, and mixtures thereof. Particularly preferred are molybdenum dithiocarbamates, dialkyldithiophosphates, alkyl xanthates and alkylthioxanthates. The molybdenum compound is dinuclear or trinuclear.

One class of preferred organo-molybdenum compounds useful in all aspects of the present invention is tri-nuclear molybdenum compounds of the formula $Mo_3S_kL_nQ_z$ and mixtures thereof wherein L are independently selected ligands having organo groups with a sufficient number of carbon atoms to render the compounds soluble or dispersible in the oil, n is from 1 to 4, k varies from 4 through to 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The molybdenum compounds may be present in a lubricating oil composition at a concentration in the range 0.1 to 2 mass %, or providing at least 10 such as 50 to 2,000 ppm by mass of molybdenum atoms.

Preferably, the molybdenum from the molybdenum compound is present in an amount of from 10 to 1500, such as 20 to 1000, more preferably 30 to 750, ppm based on the total weight of the lubricating oil composition. For some applications, the molybdenum is present in an amount of greater than 500 ppm.

Anti-oxidants are sometimes referred to as oxidation inhibitors; they increase the resistance of the composition to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth.

They may be classified as radical scavengers (e.g. sterically hindered phenols, secondary aromatic amines, and organo-copper salts); hydroperoxide decomposers (e.g., organosulfur and organophosphorus additives); and multifunctionals (e.g. zinc dihydrocarbyl dithiophosphates, which may also function as anti-wear additives, and organo-molybdenum compounds, which may also function as friction modifiers and anti-wear additives).

Examples of suitable antioxidants are selected from copper-containing antioxidants, sulfur-containing antioxidants, aromatic amine-containing antioxidants, hindered phenolic antioxidants, dithiophosphates derivatives, metal thiocarbamates, and molybdenum-containing compounds.

Dihydrocarbyl dithiophosphate metals salts are frequently used as antiwear and antioxidant agents. The metal may be an alkali or alkaline earth metal, or aluminum, lead, tin, zinc molybdenum, manganese, nickel or copper. Zinc salts are most commonly used in lubricating oil such as in amounts of 0.1 to 10, preferably 0.2 to 2, mass %, based upon the total mass of the lubricating oil compositions. They may be prepared in accordance with known techniques by first forming a dihydrocarbyl dithiophosphoric acid (DDPA), usually by reaction of one or more alcohols or a phenol with $P_2S_5$, and then neutralising the formed DDPA with a zinc compound. For example, a dithiophosphoric acid may be made by reaction with mixtures of primary and secondary alcohols. Alternatively, multiple dithiophosphoric acids can be prepared where the hydrocarbyl groups on one acid are entirely secondary in character and the hydrocarbyl groups on the other acids are entirely primary in character. To make the zinc salt, any basic or neutral zinc compound could be used but the oxides, hydroxides and carbonates are most generally employed. Commercial additives frequently contain an excess of zinc due to use of an excess of the basic zinc compound in the neutralisation reaction. Lubricating oils of the present invention may comprise a dihydrocarbyldithiophosphate metal salt in addition to that defined as component (B) in the first aspect of the invention. However, lubricating oils according to the present invention preferably comprise no dihydrocarbyldithiophophate other than component (B) as defined in the first aspect of the invention.

Anti-wear agents reduce friction and excessive wear and are usually based on compounds containing sulfur or phosphorous or both, for example that are capable of depositing polysulfide films on the surfaces involved. Noteworthy are the dihydrocarbyl dithiophosphates, such as the zinc dialkyl dithiophosphates (ZDDP's) discussed herein.

Examples of ashless anti-wear agents include 1,2,3-triazoles, benzotriazoles, thiadiazoles, sulfurised fatty acid esters, and dithiocarbamate derivatives.

Rust and corrosion inhibitors serve to protect surfaces against rust and/or corrosion. As rust inhibitors there may be mentioned non-ionic polyoxyalkylene polyols and esters thereof, polyoxyalkylene phenols, and anionic alkyl sulfonic acids.

Pour point depressants, otherwise known as lube oil flow improvers, lower the minimum temperature at which the oil will flow or can be poured. Such additives are well known. Typical of these additive are $C_8$ to $C_{18}$ dialkyl fumerate/vinyl acetate copolymers and polyalkylmethacrylates.

Additives of the polysiloxane type, for example silicone oil or polydimethyl siloxane, can provide foam control.

A small amount of a demulsifying component may be used. A preferred demulsifying component is described in EP-A-330,522. It is obtained by reacting an alkylene oxide with an adduct obtained by reaction of a bis-epoxide with a polyhydric alcohol. The demulsifier should be used at a level not exceeding 0.1 mass % active ingredient. A treat rate of 0.001 to 0.05 mass % active ingredient is convenient.

Viscosity modifiers (or viscosity index improvers) impart high and low temperature operability to a lubricating oil. Viscosity modifiers that also function as dispersants are also known and may be prepared as described above for ashless dispersants. In general, these dispersant viscosity modifiers are functionalised polymers (e.g. interpolymers of ethylene-propylene post grafted with an active monomer such as maleic anhydride) which are then derivatised with, for example, an alcohol or amine.

The lubricant may be formulated with or without a conventional viscosity modifier and with or without a dispersant viscosity modifier. Suitable compounds for use as viscosity modifiers are generally high molecular weight hydrocarbon polymers, including polyesters. Oil-soluble viscosity modifying polymers generally have weight average molecular weights of from 10,000 to 1,000,000, preferably 20,000 to 500,000, which may be determined by gel permeation chromatography or by light scattering.

EXAMPLES

The invention will now be particularly described in the following examples which are not intended to limit the scope of the claims hereof.

Lubricant 1, a lubricant of the invention, contained as additive component (B) an oil-soluble zinc salt of a dithiophosphoric acid, the acid being the reaction product of $P_2S_5$ with a mixture of sec-$C_6$ alcohol (75 mass %) and glycerol monooleate (25 mass %), the salt being made substantially as described in U.S. Pat. No. A-5,013,465.

Lubricant A, a reference lubricant, containing, instead of additive component (B) of Lubricant 1, a mixture of two separate ZDDPs comprising (i) a first oil-soluble zinc salt of a dithiophosphoric acid (78 mass %), the acid being the reaction product of $P_2S_5$ with a sec-$C_6$ alcohol; and, (ii) a second separate oil-soluble zinc salt of a dithiophosphoric acid (22 mass %), the acid being the reaction product of $P_2S_5$ with a $C_8$ alcohol, both salts being made substantially as described in U.S. Pat. No. A-5,013,465.

Lubricant B, a reference lubricant, containing, instead of additive component (B) of Lubricant 1, a ZDDP comprising a oil-soluble zinc salt of a dithiophosphoric acid, the acid being the reaction product of $P_2S_5$ with a mixture of a sec-$C_4$ alcohol (85 mass %); and, pri-$C_8$ alcohol (15 mass %), both salts being made substantially as described in U.S. Pat. No. A-5,013,465.

Lubricant C, a reference lubricant, containing, instead of additive component (B) of Lubricant 1, a ZDDP comprising an oil-soluble zinc salt of a dithiophosphoric acid being the reaction product of $P_2S_5$ with 4-methyl-2-pentanol, being made substantially as described in U.S. Pat. No. A-5,013,465.

Each lubricant also contained equal quantities of a Group III base stock (81 mass %), ashless dispersant, calcium salicylate detergent, antioxidant, foam control additive, a flow improver and a viscosity modifier.

Also each lubricant had the following analyses:

0.8 mass % sulfated ash;

0.08 mass % phosphorus; and, 0.23 mass % sulfur; and, 0.18 mass % calcium.

Each of the three lubricants was tested for phosphorus retention by employing the Sequence IIIG Test. The Test utilizes a 1996 General Motors 3800 cc Series II, water-cooled, 4 cycle, V-6 gasoline engine as the test apparatus. The Sequence III G test engine is an overhead valve design (OHV) and uses a single camshaft operating both intake and exhaust valves via pushrods and hydraulic valve lifters in a sliding-follower arrangement. Using unleaded gasoline, the engine runs a 10-minute initial oil-leveling procedure followed by a 15-minute slow ramp up to speed and load conditions. The engine then operates at 125 bhp, 3,600 rpm and 150° C. oil temperature for 100 hours, interrupted at 20-hour intervals for oil level checks.

During the course of each engine test the concentration of calcium and phosphorus was measured every 20 hours. From these measurements the percent by weight of phosphorus retained in the crankcase (% $P_{retention}$) was calculated using the following formula:

$$\% P_{retention} = \left[\frac{(\% \text{ wt } P_t)(\% \text{ wt } M_0)}{(\% \text{ wt } P_0)(\% \text{ wt } M_t)}\right] \times 100$$

wherein: % wt $P_t$ is the percent by weight of phosphorus in the lubricating oil composition after operation of the engine for a period of time t using the sequence III G Test Procedure, % wt $M_0$ is the percent by weight of calcium in the lubricating oil composition at the beginning of testing using the sequence III G Test Procedure, % wt $P_0$ is the percent by weight of phosphorus in the lubricating oil composition at the beginning of testing using the sequence III G Test Procedure, and % wt $M_t$ is the percent by weight of calcium in the lubricating oil composition after operation of the engine for a period of time t using the sequence III G Test Procedure.

The results, expressed as percent by weight of phosphorus retention after 100 hours, were as follows:

Lubricant 1: 90
Lubricant A: 86
Lubricant B: 78
Lubricant C: 84

The results demonstrate that the lubricating oil of the present invention (Lubricant 1) exhibits a significant improvement in phosphorus retention compared to the reference lubricating oils (Lubricants A, B and C).

What is claimed is:

1. A lubricating oil composition having a phosphorus concentration, expressed as atoms of phosphorus, of not greater than 0.09 mass %, based on the total mass of the composition, the lubricating oil composition comprising:

(A) an oil of lubricating viscosity in a major amount; and, (B) as an additive component in a minor amount, an oil-soluble zinc salt of a dithiophosphoric acid, the dithiophosphoric acid being the reaction product of phosphorus pentasulphide with a mixture comprising at least one first alcohol of the formula ROH where R is an aliphatic hydrocarbyl group having at least four carbon atoms or is an alkaryl group, and at least one second alcohol which is an ester of a glycerol and a mono-carboxylic acid containing at least 9 carbon atoms and 0 to 3 carbon-carbon double bonds.

2. The composition as claimed in claim 1 further including an alkali or alkaline earth metal salicylate detergent as an additive in a minor amount.

3. The composition as claimed in claim 2 wherein the alkali or alkaline earth metal salicylate detergent comprises an alkaline earth metal salicylate detergent.

4. The composition as claimed in claim 3 wherein the alkaline earth metal salicylate detergent is a calcium salicylate detergent.

5. The composition as claimed in claim 1 wherein R of the at least one first alcohol has from 4 to 10 carbon atoms.

6. The composition as claimed in claim 5 wherein R of the at least one first alcohol has from 5 to 8 carbon atoms.

7. The composition as claimed in claim 1 wherein R of the at least one first alcohol comprises an aliphatic hydrocarbyl group.

8. The composition as claimed in claim 7 wherein R comprises an alkyl group.

9. The composition as claimed in claim 8 wherein greater than 60 mole % of the alkyl groups which R represents are secondary alkyl groups.

10. The composition as claimed in claim 1 wherein ROH comprises 4-methyl pentan-2-ol.

11. The composition as claimed in claim 1 wherein the second alcohol is an ester of glycerol and a mono-carboxylic acid containing 12 to 30 carbon atoms.

12. The composition as claimed in claim 1 wherein the second alcohol comprises a mono-ester of glycerol and the mono-carboxylic acid, a diester of glycerol and the mono-carboxylic acid, or a mixture thereof.

13. The composition as claimed in claim 12 wherein the second alcohol comprises a mono-ester of glycerol and the mono-carboxylic acid.

14. The composition as claimed in claim 1 wherein the carboxylic acid is a saturated or unsaturated $C_{16}$ to $C_{18}$ fatty acid.

15. The composition as claimed in claim 1 wherein the carboxylic acid is a saturated or unsaturated $C_{16}$ to $C_{18}$ fatty acid.

16. The composition as claimed in claim 1 wherein the composition has a sulfur concentration, expressed as atoms of sulfur, of not greater than 0.4 mass %.

17. The composition as claimed in claim 16 wherein the composition has a sulfur concentration, expressed as atoms of sulfur, of not greater than 0.3 mass %.

18. The composition as claimed in claim 1 wherein the composition has a sulfated ash concentration of not greater than 1.0 mass %.

19. The composition as claimed in claim 1 further comprising one or more co-additives in a minor amount, other than additive component (B), selected from ashless dispersants, metal detergents, corrosion inhibitors, antioxidants, pour point depressants, antiwear agents, friction modifiers, demulsifiers, antifoam agents and viscosity modifiers.

20. A method of lubricating a compression-ignited or spark-ignited internal combustion engine comprising operating the engine with a lubricating oil composition as claimed in claim 1.

21. A method of improving the efficiency and/or reducing the contamination of an exhaust gas after treatment device of an internal combustion engine, the exhaust gas after treatment device including a catalyst, the method comprising operating the engine with a lubricating oil composition as claimed in claim 1.

22. A method of reducing the concentration of phosphorus and/or phosphorus containing compounds introduced into the exhaust gas of an internal combustion engine, the method comprising operating the engine with a lubricating oil composition as claimed in claim 1.

* * * * *